US006840557B1

(12) United States Patent
Manthey

(10) Patent No.: US 6,840,557 B1
(45) Date of Patent: Jan. 11, 2005

(54) SELF SUPPORTING HAND HELD IMPLEMENT

(76) Inventor: Tracy E. Manthey, 714 Emerald St., New Orleans, LA (US) 70124

( * ) Notice: Subject to any disclaimer, the term of this patent is extended or adjusted under 35 U.S.C. 154(b) by 129 days.

(21) Appl. No.: 10/207,321

(22) Filed: Jul. 29, 2002

(51) Int. Cl.[7] ..... A46B 17/00

(52) U.S. Cl. ..... 294/19.1; 248/110; 15/144.1; 15/175

(58) Field of Search ..... 294/19.1, 50, 50.5, 294/57, 58, 59, 1.4, 100; 248/110, 151, 155.2, 155.3, 439; 15/144.1, 144.3, 144.4, 148, 149, 151, 175

(56) References Cited

U.S. PATENT DOCUMENTS

| | | | | |
|---|---|---|---|---|
| 636,074 A | | 10/1899 | Skoog | |
| 1,863,756 A | | 6/1932 | Lufkin | |
| 1,871,667 A | | 8/1932 | Dalton | |
| 2,753,879 A | | 7/1956 | Rosen | |
| 2,762,408 A | * | 9/1956 | Baldwin | 294/100 |
| 2,794,667 A | * | 9/1957 | Bissitt | 294/100 |
| 4,091,828 A | | 5/1978 | Jorgensen | |
| 5,317,939 A | * | 6/1994 | Marinescu | 81/53.11 |
| 5,375,288 A | * | 12/1994 | Seagren | 15/175 |
| 6,125,867 A | | 10/2000 | Ishizaka | |

FOREIGN PATENT DOCUMENTS

| | | |
|---|---|---|
| CH | 15492 | 10/1897 |
| FR | 627.895 | 10/1927 |
| FR | 99.822 | 3/1968 |
| SE | 93140 | 10/1938 |

* cited by examiner

*Primary Examiner*—Dean J. Kramer
(74) *Attorney, Agent, or Firm*—Charles Garvey

(57) ABSTRACT

A self supporting implement apparatus includes an elongated handle having upper and lower end portions and a working tool end portion that is affixed to the lower end portion of the handle. The combination of handle and working tool end portion define an implement to be gripped and manipulated by a user. A sleeve provides a central longitudinal bore that is sized and shaped to receive the handle, the sleeve having a gripping surface and a lower end portion with a plurality of separate legs having slots there between, each leg having a foot. A fitting is attached to the handle above the tool end portion, the fitting having a plurality of passages, one passage for each leg. Each of the passages is shaped to divert a leg away from the central longitudinal axis of the handle so that the foot of each leg can define engage a floor surface at a position that is spaced radially from the central longitudinal axis of the handle. The legs and feet define a multi-leg base that supports the implement in a generally vertical position when it is not in use.

18 Claims, 2 Drawing Sheets

18
17
19
16
26
25
4
4

27
28
28

25
26
26
26
25
26

30
31
27
29
30
30
28
28
32
5
5

28
32
33

21

13
12
10
11
21
17
16
25
26
15A 10
21
22
22
18
17
20
19
24
25
25
14
15

21
35
17
19
16
26
28
28
35
35
25
25
15
36

10
15
15B
34
36
15

10
36
34
15C
36

SELF SUPPORTING HAND HELD IMPLEMENT

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to hand held implements having elongated handles such as brooms, mops, paint rollers, and the like. Even more particularly, the present invention relates to an improved self-supporting implement that has an elongated handle that can be gripped by a user and a working tool end portion, the handle having a specially configured multi-leg footing that extends between an expanded lower position for use when supporting the implement in a generally vertical position and a retracted position wherein the legs are aligned next to the handle when the implement is being used.

2. General Background of the Invention

Many hand held implements have elongated handles that are typically between about a few to several feet long. Such implements can include as examples broom, mop, paint roller, squeegee, walking cane, pool net, tiki torch, flag pole, rake and shovel.

When using such an elongated hand held implement, a user is frequently required to release his or her grip on the implement such as when moving furniture, when obtaining supplies to be used with the implement, or when not using the implement and it is dripping liquid (eg. mop, paint roller). This presents a problem in that a user must repeatedly bend over to pick up the implement when the implement is to be used again. Over a period of time, this can create an unsafe working environment, be very burdensome to the user, especially in cases wherein the user is elderly or has a chronic back problem or other physical impairment.

Several patents have issued that relate generally to the supporting of an elongated object. U.S. Pat. No. 636,074 discloses a cane that has an expanding base that converts it into a stool.

The Dalton U.S. Pat. No. 1,871,667 discloses a signal flag and lamp stand device that has retractable legs at the lower end portion of the device.

A Swedish patent 93140 discloses a structure that has a movable tripod base support that appears to retract.

French patent 627895 discloses an elongated support structure having retractable legs. Another French patent, 1515494 discloses a vertically extending support device having a plurality of retractable legs.

The Lufkin U.S. Pat. No. 1,863,756 discloses a portable stand that includes a hollow column threaded externally at its lower end, a hub having threads for engagement with the threaded end of the column, and a plurality of radially extending sockets, ears disposed on opposing sides of the sockets and carrying pivots, feet carried between the ears having their inner ends slidably engaging the sockets, the feet having longitudinal slots through which the pivots pass and a spring engaging each foot and its pivot and tending when the foot is swung down to push it into the socket and when the foot is swung up to push its lower extremity across the length of the socket so as to lock it in the collapsed position.

A collapsible stand for umbrellas and the like is the subject of U.S. Pat. No. 2,753,879. The collapsible stand for an umbrella or the like includes an elongated hollow shaft open at one end, at least three elongated springy legs which are arcuate in their unstressed condition, the legs being located beside each other and inside the shaft for movement between a collapsed position, where the legs are located substantially entirely within the shaft and an expanded position where the legs extend through a substantial distance through and beyond the open end of the shaft and spread apart from each other to provide at least a three point support, manually operable moving means shiftable with respect to the shaft and connected to the legs for moving the same between the collapsed and expanded positions and an umbrella sheet fixed to the shaft.

The Jorgensen U.S. Pat. No. 4,091,828 discloses a walking cane with a collapsible stand adjacent its tip shiftable from an extended position wherein the stand supports the cane in an upright attitude, to a collapsed position where the stand nests neatly along the body of the cane above the tip, permitting the latter to engage the ground when the cane is used for walking. A manually manipulatable remote control lever on the cane is mounted for over center operation to permit selective locking of the stand in either its expanded or collapsed position.

BRIEF SUMMARY OF THE INVENTION

The present invention provides an implement and support apparatus that includes an elongated handle having upper and lower end portions and a working tool affixed to the lower end portion of the handle. The combination of the handle and the tool end portion define an implement to be gripped and manipulated by a user.

The handle carries a sleeve that has a central longitudinal bore sized and shaped to receive the handle, the sleeve having a gripping surface and a lower end portion with a plurality of separate legs having slots there between, each leg having a foot.

The sleeve is slidably mounted to the handle and moves between upper and lower positions.

A guide or spreader fitting is attached to the handle above the tool end portion, the guide or spreader fitting having a plurality of passageways, one passageway for each leg.

Each of the passageways is shaped to divert a leg away from the central longitudinal axis of the handle, so that the tip of each leg defines a foot for engaging a floor surface at a position that is spaced radially away from the central longitudinal axis of the handle. The legs and feet define a multi-leg base that supports the implement in a generally vertical position when the sleeve and legs are moved to the lower, extended position.

A stop can be positioned on the handle (or manufactured as part of the handle) above the sleeve so that the stop limits upward movement of the sleeve during use.

The legs can provide a curved transverse cross section. The sleeve can also provide a curved wall wherein each leg is curved transversely so that it conforms to the shape of the sleeve. However, the transverse cross section could be triangular and the device have three legs. The transverse cross section could be square and the device have four legs.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figures 1, 2, 3, 4, 5, 6:
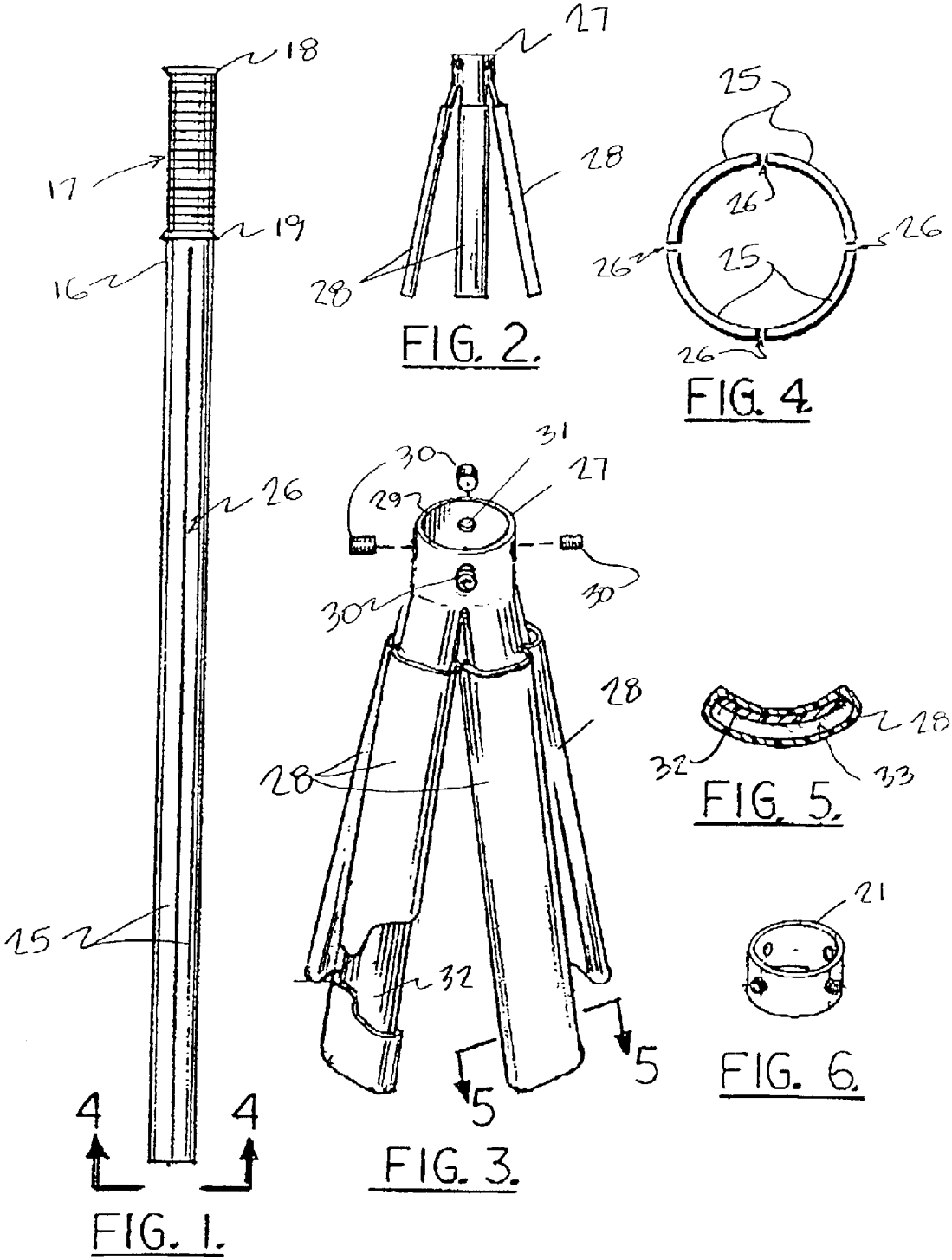
FIG. 1 is a partial perspective view of the preferred embodiment of the apparatus of the present invention illustrating the sleeve and its legs.
FIG. 2 is a partial perspective elevation view of the preferred embodiment of the apparatus of the present invention illustrating the guide member.
FIG. 3 is a partial perspective view of the preferred embodiment of the apparatus of the present invention illustrating the guide member.
FIG. 4 is an end view taken along lines 4—4 of FIG. 1.
FIG. 5 is a sectional view taken along lines 5—5 of FIG. 3.
FIG. 6 is a partial perspective view of the preferred embodiment of the apparatus of the present invention illustrating the stop.

The present invention provides an improved implement and support apparatus shown in FIGS. 7-11 and designated generally by the numeral 10. Implement and support apparatus 10 includes an implement 11 that has an elongated handle 12 that can be a number of feet (eg. 2–4 feet) in length. Implement 11 can be any implement having an elongated handle such as a mop, broom, rake, shovel, paint roller, as examples. Elongated handle 12 has an upper end 13 and a lower end 14. The lower end 14 can provide a working tool end portion 15 that is a mop 15*a* in FIGS. 7, 8 and 9, a broom 15*b* in FIG. 10 and a paint roller 15*c* in FIG. 11. However, other working tool end portions could optionally be provided at the lower end 14 (or at the upper end 13) of handle 12.

Figures 7, 8, 9, 10, 11:
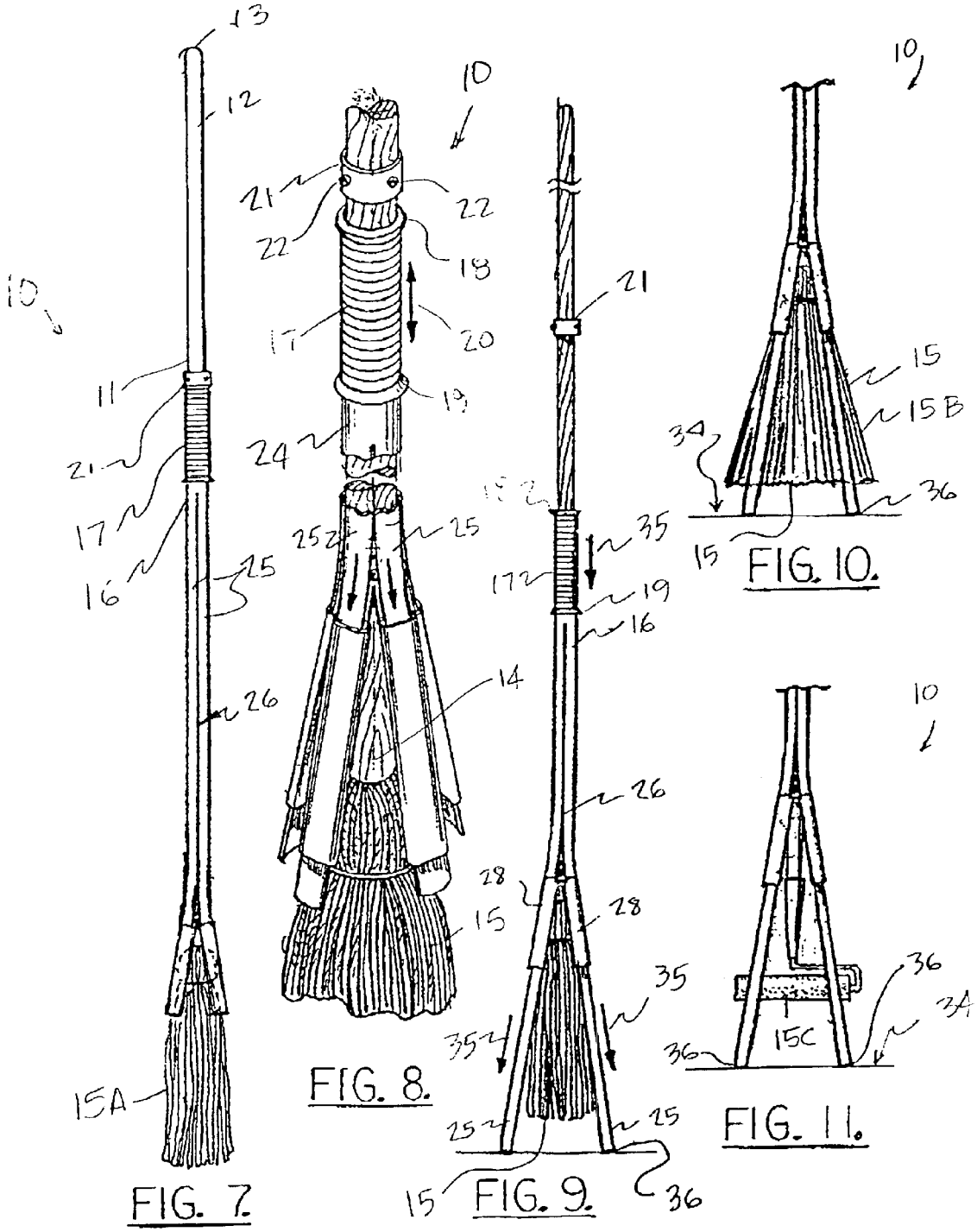
FIG. 7 is a perspective, elevation view of the preferred embodiment of the apparatus of the present invention showing the legs in the retracted position.
FIG. 8 is a partial perspective view of the preferred embodiment of the apparatus of the present invention showing the legs in a transition position as the sleeve moves downwardly toward the working tool end portion of the apparatus.
FIG. 9 is a perspective elevation view of the preferred embodiment of the apparatus of the present invention showing the legs in the extended position.
FIG. 10 is a partial perspective view of the preferred embodiment of the apparatus of the present invention showing the legs in an extended position and illustrating an additional tool end portion in the form of a broom.
FIG. 11 is a partial, perspective view of the preferred embodiment of the apparatus of the present invention showing the legs in an extended position and illustrating yet another tool end portion, a paint roller.

In FIGS. 1, 7, 8 and 9, an elongated sleeve 16 is provided. Sleeve 16 is sized and shaped to slide upon handle 12 between upper and lower positions. Sleeve 16 provides a gripping surface 17 and can provide a pair of annular collars 18, 19 that are positioned respectively above and below gripping surface 17 for enabling a user's hand to register upon the gripping surface 17 and not slide off during use. Arrow 20 in FIGS. 8 and 9 illustrates that a user can slide the sleeve 16 either downwardly to a extended, supporting position as shown in FIG. 9 or to a retracted position as shown in FIG. 7. Arrows 35 in FIG. 9 illustrate the downward movement of sleeve 16 relative to handle 12, as sleeve 16 moves from the retracted to the extended position.

A stop 21 can be positioned on handle 12 above sleeve 16 as shown in FIG. 7. The stop 21 can be in the nature of an annular ring structure having a plurality of set screws 22 for anchoring it to the handle 12 and added to the handle or an integral part of the handle. The stop 21 is positioned so that it limits upward movement of the sleeve 16 when the legs 25 have reached the retracted position shown in FIG. 7. The stop can be an enlarged part or foot on some or all of the legs.

A transition section 24 of sleeve 16 is provided below gripping surface 17 and annular collar 19, and above legs 25. Legs 25 are elongated extensions of sleeve 16. There is a slot 26 in between each pair of legs 25, as shown in FIGS. 1 and 7.

A spreader fitting or guide member 27 is provided for spreading the plurality of legs 25 to an extended position of FIG. 9. The spreader 27 includes a plurality of spreader tubes 28 that extend down from collar 29. A plurality of set screws 30 can be provided for attaching collar 29 to handle 12 at a position just above the working tool end 15. Each set screw 30 engages an internally threaded opening 31 of collar 29. Collar 29 could be thickened at set screws 30 so that the set screws 30 have better bit or purchase.

Each spreader tube 28 can be of a flexible or rigid plastic or metal material, having a (eg. metal) stiffener 32 or can be flat if a triangular or square transverse cross section is employed, the stiffener 32 can be arcuate in cross section as shown in FIG. 5. Likewise, the legs 25 are arcuate in cross section as shown in FIG. 4. In this fashion, a leg 25 easily tracks through a hollow passageway 33 of a spreader tube 28. The legs 25 are preferably curved in cross section, shaped to closely conform to the outer surface of handle 12 when the sleeve 16 is moved to the retracted position of FIG. 7.

In order to use the selected implement 10, a user simply grips the surface 17 and slides sleeve 16 to the upper position of FIG. 7. The legs 25 are retracted as the sleeve 16 is moved upwardly until they are above the working tool end portion 15 of the apparatus 10. In order to support the apparatus 10 in a generally vertical position upon a selected underlying support surface such as a floor 34 shown in FIGS. 9, 10 and 11, the user grips surface 17 and slides sleeve 16 downwardly in the direction of arrow 35. The legs 25 extend through passageways 33 of spreader tubes 28 until the legs 25 extend below the lowermost end portion of the working tool end portion 15, as shown in FIGS. 9, 10 and 11. In this position, each leg 25 provides a foot 36 that engages floor 34 below the working tool end 15.

The following is a list of suitable parts and materials for the various elements of the preferred embodiment of the present invention.

PARTS LIST

| PART NUMBER | DESCRIPTION |
|---|---|
| 10 | implement and support apparatus |
| 11 | implement |
| 12 | elongated handle |
| 13 | upper end |
| 14 | lower end |
| 15 | working tool end |
| 15a | mop |
| 15b | broom |
| 15c | paint roller |
| 16 | sleeve |
| 17 | gripping surface |
| 18 | annular collar |
| 19 | annular collar |
| 20 | arrow |
| 21 | stop |
| 22 | set screw |
| 24 | transition sleeve |
| 25 | leg |
| 26 | slot |
| 27 | spreader |
| 28 | spreader tube |
| 29 | collar |
| 30 | set screw |
| 31 | internally threaded opening |
| 32 | spreader tube stiffener |
| 33 | hollow passageway |
| 34 | floor |
| 35 | arrow |

The foregoing embodiments are presented by way of example only; the scope of the present invention is to be limited only by the following claims.

What is claimed is:

1. A self supporting implement, comprising:

a) an elongated handle having upper and lower end portions;

b) a working tool affixed to the lower end portion of the handle;

c) the combination of handle and tool defining an implement to be gripped and manipulated by a user;

d) a sleeve that has a central longitudinal bore sized and shaped to receive the handle, the sleeve having an upper end portion that provides a gripping surface and a lower end portion having a plurality of separate legs with slots there between, each leg having a foot, the sleeve being slidable upon the handle between upper and lower positions;

e) a fitting that is attached to the handle above the working tool, the fitting having a plurality of passages, one passage for each leg;

f) each of the passages being shaped to divert a leg away from the central longitudinal axis of the handle so that the tip of each leg defines a foot for engaging a floor surface at a position that is spaced radially from the central longitudinal axis of the handle so that the legs and feet define an expanded base that supports the implement in a generally vertical position; and g) wherein the legs are retracted to a generally aligned position next to the handle when the sleeve slides to the upper position.

2. The implement of claim 1 wherein the legs are an integral part of the sleeve.

3. The implement of claim 1 wherein the legs flex during movement of the sleeve from the upper to the lower sleeve position.

4. The implement of claim 1 wherein the legs bend during movement of the sleeve from the upper to the lower sleeve position.

5. The implement of claim 1 further comprising a stop that limits travel of the legs.

6. An implement support stand for supporting an implement having an elongated handle in a generally vertical position, comprising:

a) a sliding member having a hollow central bore for enabling the member to be mounted to the elongated handle of a selected implement with the handle occupying the bore, the member having upper and lower end portions, and being movable between extended and retracted positions;

b) a plurality of at least three legs extending from the lower end of the sliding member, each leg having an upper end that extends from the member and a lower free end defining a ground engaging foot;

c) a leg guide member that has an attachment for holding the guide member to the handle of the implement below the sliding member, the guide member including means for diverging the legs away from the handle central axis so the leg feet are spaced laterally away from the implement to define an expanded base that enables the feet and legs to hold the implement and its handle in a generally vertical position; and d) wherein the feet extend below the implement in the extended position.

7. The implement support stand of claim 6 wherein the member has a wall, and the legs extend downwardly from the wall.

8. The implement support stand of claim 6 wherein the legs have a curved transverse cross section.

9. The implement support stand of claim 6 wherein the sliding member has a curved wall and each leg is curved transversely so that it conforms to the sliding member wall.

10. The implement support stand of claim 6 further comprising a stop that limits travel of the legs.

11. A self supporting implement apparatus comprising:

a) an elongated handle having upper and lower end portions;

b) a working tool end portion affixed to the lower end portion of the handle;

c) the combination of handle and tool end portion defining an implement to be gripped and manipulated by a user;

d) a sleeve that has a central longitudinal bore sized and shaped to receive the handle, the sleeve having a gripping surface and a lower end portion with a plurality of at least three separate legs with slots there between, each leg having a foot;

e) a guide fitting that is attached to the handle above the tool end portion, the fitting having a plurality of passages, one passage for each leg; and f) each of the passages being shaped to divert a leg away from the central longitudinal axis of the handle so that the feet extend below the working tool end portion in the extended position enabling the feet to contact an underlying floor surface at a position that is spaced radially from the central longitudinal axis of the handle, the legs and feet defining a multi-leg base that supports the implement in a generally vertical position.

12. The self supporting implement apparatus of claim 11 wherein the legs are an integral part of the sleeve.

13. The self supporting implement apparatus of claim 11 wherein the legs flex during movement of the sleeve from an upper to a lower sleeve position.

14. The self supporting implement apparatus of claim 11 wherein the legs bend during movement of the sleeve from an upper to a lower sleeve position.

15. The self supporting implement apparatus support stand of claim 11 wherein the sleeve has a wall, and at least some of the legs extend from the wall.

16. The self supporting implement apparatus of claim 11 wherein the legs have a curved transverse cross section.

17. The self supporting implement apparatus of claim 11 wherein the sleeve has a curved wall and each leg is curved transversely so that it conforms to the sleeve wall.

18. The self supporting implement apparatus of claim 11 further comprising a stop that limits travel of the legs.

* * * * *